US006641415B2

(12) United States Patent
Maegawa

(10) Patent No.: US 6,641,415 B2
(45) Date of Patent: Nov. 4, 2003

(54) CABLE REEL HAVING INNER CASES

(75) Inventor: Akihito Maegawa, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/190,532

(22) Filed: Jul. 9, 2002

(65) Prior Publication Data

US 2003/0013335 A1 Jan. 16, 2003

(30) Foreign Application Priority Data

Jul. 16, 2001 (JP) ..... 2001-215706

(51) Int. Cl.[7] ..... H01R 3/00
(52) U.S. Cl. ..... 439/164; 439/15
(58) Field of Search ..... 439/164, 15, 452, 439/456

(56) References Cited

U.S. PATENT DOCUMENTS 5,651,686 A * 7/1997 Okuhara et al. ..... 439/164
5,683,259 A * 11/1997 Sato ..... 439/164
5,762,507 A * 6/1998 Mochizuki et al. ..... 439/164
6,007,355 A 12/1999 Shibata et al. ..... 439/164
6,341,969 B1 * 1/2002 Taniuchi et al. ..... 439/164

FOREIGN PATENT DOCUMENTS

JP 6203940 7/1994 ..... H01R/35/04
JP 7169544 7/1995 ..... H01R/35/04

OTHER PUBLICATIONS

English Language Abstract for JP Appln. No. 6–203940.
English Language Abstract for JP Appln. No. 7–169544.

* cited by examiner

*Primary Examiner*—Lynn Feild
*Assistant Examiner*—Hae Moon Hyeon
(74) *Attorney, Agent, or Firm*—Greenblum & Bernstein, P.L.C.

(57) ABSTRACT

A cable reel includes a stationary member forming an outer cylinder and a movable member forming an inner cylinder and rotatably coupled to the stationary member. A flat cable is accommodated in an annular space defined by the stationary and movable members. First and second inner cases that accommodate bus bars are attached to opposite ends of the flat cable. The first and second inner cases are fixed in first and second inner case containing portions provided in the movable and stationary members, respectively. A first protection rib extends from an end surface of a cable outlet portion of the first inner case. The first protection rib includes an arcuate inner peripheral wall and an arcuate outer peripheral wall. The arcuate outer and inner peripheral walls are opposed to each other to define a cable threading path between them.

16 Claims, 6 Drawing Sheets

CABLE REEL HAVING INNER CASES

BACKGROUND OF THE INVENTION

1. Field of the Invention

The present invention relates to a cable reel to be mounted on a steering device of a vehicle such as, for example, an automobile.

2. Description of Related Art

For convenience of explanation, a prior art cable reel will be described with reference to FIGS. 6 through 8. FIG. 6 is an exploded perspective view of a prior art cable reel. FIG. 7 is a bottom view of a prior art inner case, illustrating the inner case attached to a movable member. FIG. 8 is a top view of the prior art inner case, illustrating the inner case attached to a stationary member.

A conventional cable reel to be mounted on a steering device of an automobile, as shown in FIG. 6, has a stationary member 1 adapted to be secured to a steering column and a movable member 2 adapted to be secured to a steering wheel. Both members 1 and 2 are rotatably coupled to each other. A flat cable 3 is contained in an annular space defined between the stationary member 1 and the movable member 2 in a coiled manner.

An end of the flat cable 3 is connected to an end of a bus bar 5 fixed in an inner case 4 while the other end of the flat cable 3 is connected to an end of a bus bar 8 fixed in an inner case 7. The other ends of the bus bars 5 and 8 are connected to lead wires 6 and 9, respectively.

The first inner case 4 is accommodated in a first inner case containing portion 2*a* in the movable member 2 while the second inner case 7 is accommodated in a second inner case containing portion 1*a* in the stationary member 1.

However, the flat cable 3 is caught by a guide rib 2*b* when the first inner case 4, connected to the end of the flat cable 3, is inserted into the first inner case containing portion 2*a* in the movable member 2 by sliding the inner case 4 upwardly in the portion 2*a*, as shown in FIG. 7, since the guide rib 2*b* extends arcuately from an end of a cable outlet portion of the case containing portion 2*a*. This results in lowering the efficiency of the assembly operation and in damaging the flat cable 3.

Similarly, the flat cable 3 is caught by a guide rib 1*b* when the second inner case 7, connected to the other end of the flat cable 3 is inserted into the second inner case containing portion 1*a* in the stationary member 1 by sliding the inner case 7 downwardly in the portion 1*a*, as shown in FIG. 8, since the guide rib 1*b* extends arcuately from an end of a cable outlet portion of the case containing portion 1*a*. This results in lowering the efficiency of the assembly operation and in damaging the flat cable 3.

SUMMARY OF THE INVENTION

An object of the present invention is to provide a cable reel that can improve efficiency of an assembly operation and prevent a flat cable from being damaged when inner cases connected to opposite ends of the flat cable are attached to a housing of the cable reel.

In order to overcome the above problems, an aspect of the present invention is directed to provide a cable reel wherein a movable member forming an inner cylinder is rotatably coupled to a stationary member forming an outer cylinder, a flat cable is accommodated in an annular space defined by the stationary and movable members, first and second inner cases that accommodate bus bars connected to conductive elements in the flat cable are attached to longitudinal opposite ends of the flat cable, the bus bars are drawn out from the first and second inner cases, and the first and second inner cases are fixed in first and second inner case containing portions provided in the movable and stationary members, respectively. The cable reel is characterized in that: a first protection rib extends from an end surface of a cable outlet portion in the first inner case fixed in the first inner case containing portion in the movable member; and the first protection rib includes an arcuate inner peripheral wall and an arcuate outer peripheral wall in the first inner case, the arcuate outer and inner peripheral walls being opposed to each other to define a cable-threading path between them.

In the above construction, the flat cable is not caught by the guide rib of the first inner case containing portion and the flat cable can be prevented from being damaged, since the first protection rib extending from the end surface of the first inner case protects the opposite side surfaces of the flat cable, when the first inner case is inserted into the first inner case containing portion of the movable member.

Since the inner and outer peripheral walls of the first protection rib, that serves to protect opposite side surfaces of the flat cable, are formed into an arcuate configuration, an outer shape of the first inner case including the first protection rib is substantially the same as an inner shape of the first inner case containing portion including the guide rib, thereby smoothing and improving an inserting operation of the first inner case into the first inner case containing portion.

In addition, since the flat cable extending from the first inner case is held in an arcuate shape, the flat cable can be led in a rotating direction continuously and can be wound smoothly into the annular space.

A distal end of the first protection rib is preferably disposed on a tangential line on an outer peripheral surface of the inner cylinder of the movable member. That is, the distal end of the first protection rib coincides with a portion of the flat cable drawn out from the first inner case. The distal end of the first protection rib of the first inner case is disposed on a tangential line on an outer peripheral surface of the inner cylinder of the movable member. Consequently, it is possible to prevent the flat cable from being curved excessively toward the outer cylinder when the flat cable is introduced into the annular space.

A second protection rib extends from an end surface of a cable outlet portion in the second inner case fixed in the second inner case containing portion in the stationary member. The second protection rib includes an arcuate inner peripheral wall and an arcuate outer peripheral wall in the second inner case. The arcuate inner and outer peripheral walls are opposed to each other to define a cable-threading path between them.

In the above construction, as stated in the first inner case, the flat cable is not caught by the guide rib of the second inner case containing portion, since the second protection rib extending from the end surface of the second inner case protects the opposite side surfaces of the flat cable, when the second inner case is inserted into the second inner case containing portion of the stationary member, thereby preventing the flat cable from being damaged and thereby smoothing and improving an inserting operation of the second inner case into the second inner case containing portion.

A further aspect of the present invention provides a cable reel in which a movable member forming an inner cylinder is rotatably coupled to a stationary member forming an outer cylinder and a flat cable is positioned in an annular space defined by the stationary and movable members, first and second inner cases that accommodate bus bars connected to conductive elements in the flat cable are attached to longitudinal opposite ends of the flat cable, the bus bars extend from the first and second inner cases, and the first and second inner cases are fixed in first and second inner case containing portions provided in the movable and stationary members, respectively, is provided in which one of the first and second inner cases includes a first protection rib extending from an end surface of a cable outlet portion of one of the first and second inner cases, and wherein the first protection rib includes an arcuate portion defining a cable threading path.

According to another aspect of the present invention, a distal end of the first protection rib may be positioned on a tangential line on an outer peripheral surface of the inner cylinder of the movable member. Further, a distal end of the second protection rib may be positioned on a tangential line on an outer peripheral surface of the outer cylinder of the stationary member.

According to a further aspect of the present invention, the first protection rib may extend from an end surface of a cable outlet portion in the first inner case fixed in the first inner case containing portion in the movable member, and the cable reel may further include a second protection rib extending from an end surface of a cable outlet portion of the second inner case fixed in the second inner case containing portion in the stationary member, and the second protection rib may include an arcuate portion defining a second cable threading path. Further, the first inner case containing portion may include a first arcuate guide rib, and the arcuate portion of the first protection rib may be configured to engage the first arcuate guide rib, and the second inner case containing portion may include a second arcuate guide rib, and the arcuate portion of the second protection rib is configured to engage the second arcuate guide rib. Further, the first protection rib may include an inner arcuate peripheral wall and an outer arcuate peripheral wall, the inner and outer arcuate peripheral walls of the first protection rib being opposed to each other to define the cable threading path therebetween, the first inner case containing portion includes a first arcuate guide rib, and the inner and outer arcuate peripheral walls of the first protection rib may be configured to engage the first arcuate guide rib, and the second inner case containing portion may include a second arcuate guide rib, and the inner and outer arcuate peripheral walls of the second protection rib may be configured to engage the second arcuate guide rib.

In a further aspect of the present invention, the first protection rib may include an inner arcuate peripheral wall and an outer arcuate peripheral wall, the inner and outer arcuate peripheral walls being opposed to each other and defining the cable threading path therebetween. Further, the first protection rib may extend from an end surface of a cable outlet portion in the first inner case fixed in the first inner case containing portion provided in the movable member. The first protection rib may extend from an end surface of a cable outlet portion in the second inner case fixed in the second inner case containing portion provided in the stationary member, and the second inner case containing portion may include an arcuate guide rib, and the arcuate portion of the first protection rib is configured to engage the arcuate guide rib.

According to a further aspect of the present invention, the first inner case containing portion may include an arcuate guide rib, and the arcuate portion of the first protection rib may be configured to engage the arcuate guide rib. Further, the inner and outer arcuate peripheral walls may extend from an end surface of a cable outlet portion in the first inner case fixed in the first inner case containing portion provided in the movable member. Further, the inner and outer arcuate peripheral walls may extend from an end surface of a cable outlet portion in the second inner case fixed in the second inner case containing portion in the stationary member, and the second inner case containing portion may include an arcuate guide rib, and the inner and outer arcuate peripheral walls are configured to engage the arcuate guide rib.

In a further aspect of the present invention, the second protection rib may include an inner arcuate peripheral wall and an outer arcuate peripheral wall, the inner and outer arcuate peripheral walls of the second protection rib being opposed to each other to define the second cable threading path therebetween.

BRIEF DESCRIPTION OF THE DRAWINGS

The foregoing and other objects, features and advantages of the present invention will become apparent from the following description of the preferred embodiments, given as non-limiting examples, with reference to the accompanying drawings, in which.

DETAILED DESCRIPTION OF THE PREFERRED EMBODIMENTS

Figure 1:
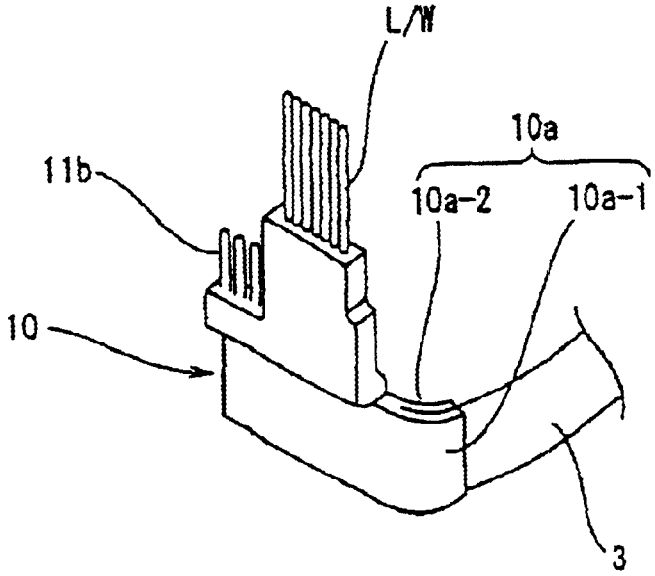
FIG. 1 is a perspective view of an inner case of a first embodiment in accordance with the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Referring now to the drawings, embodiments of a cable reel in accordance with the present invention will be explained below.

Figure 6:
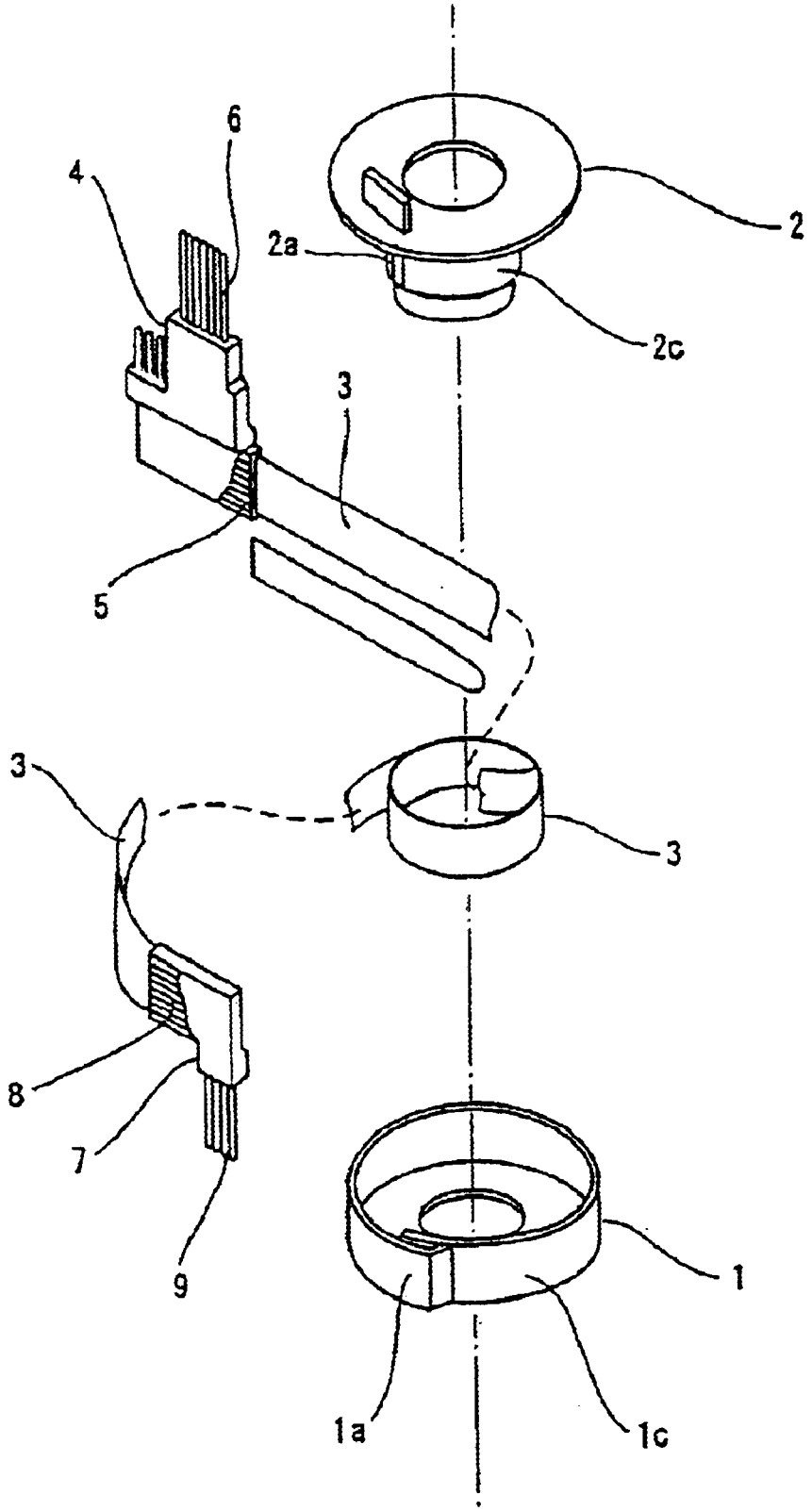
FIGURE 6 PRIOR ART
FIG. 6 is an exploded perspective view of a prior art cable reel.
Figure 7:
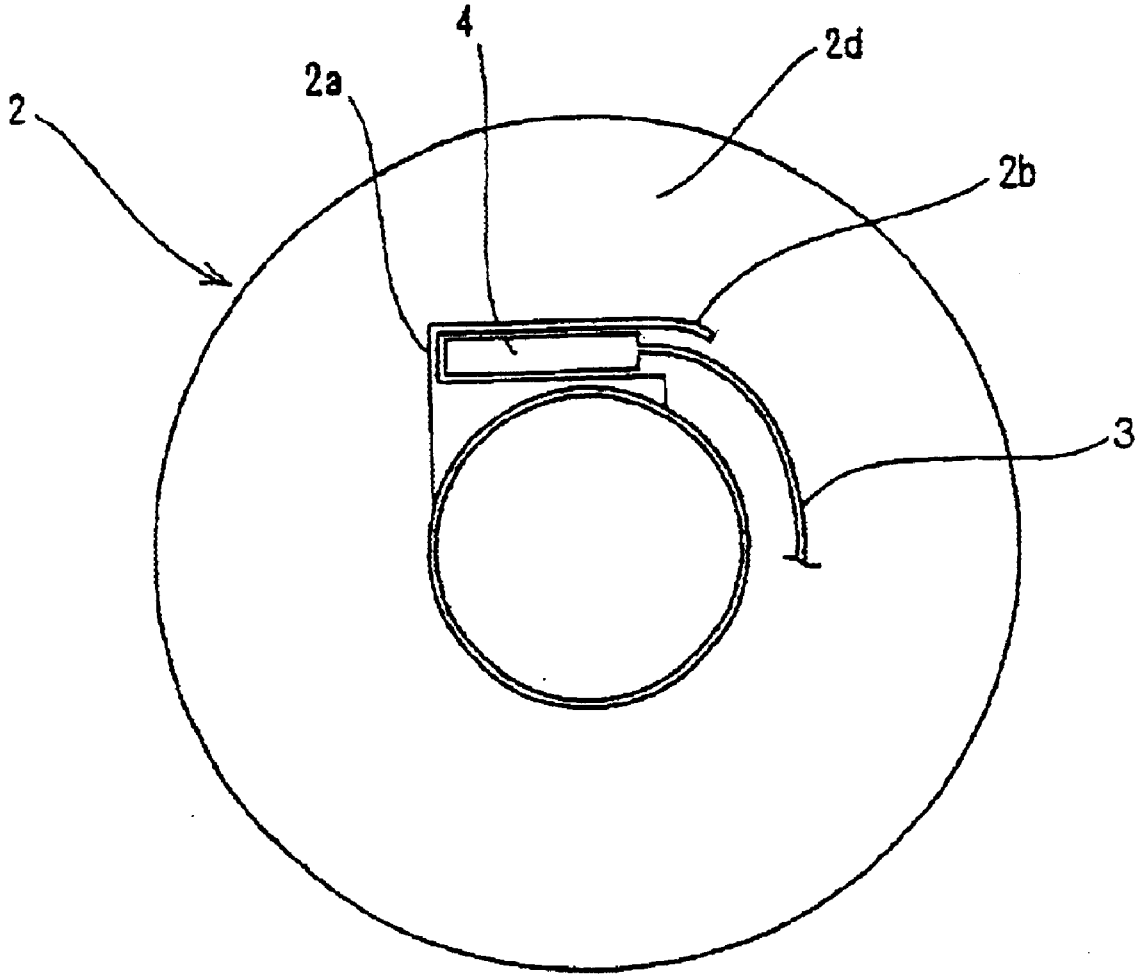
FIGURE 7 PRIOR ART
FIG. 7 is a bottom view of a prior art inner case, illustrating the inner case attached to a movable member.
Figure 8:
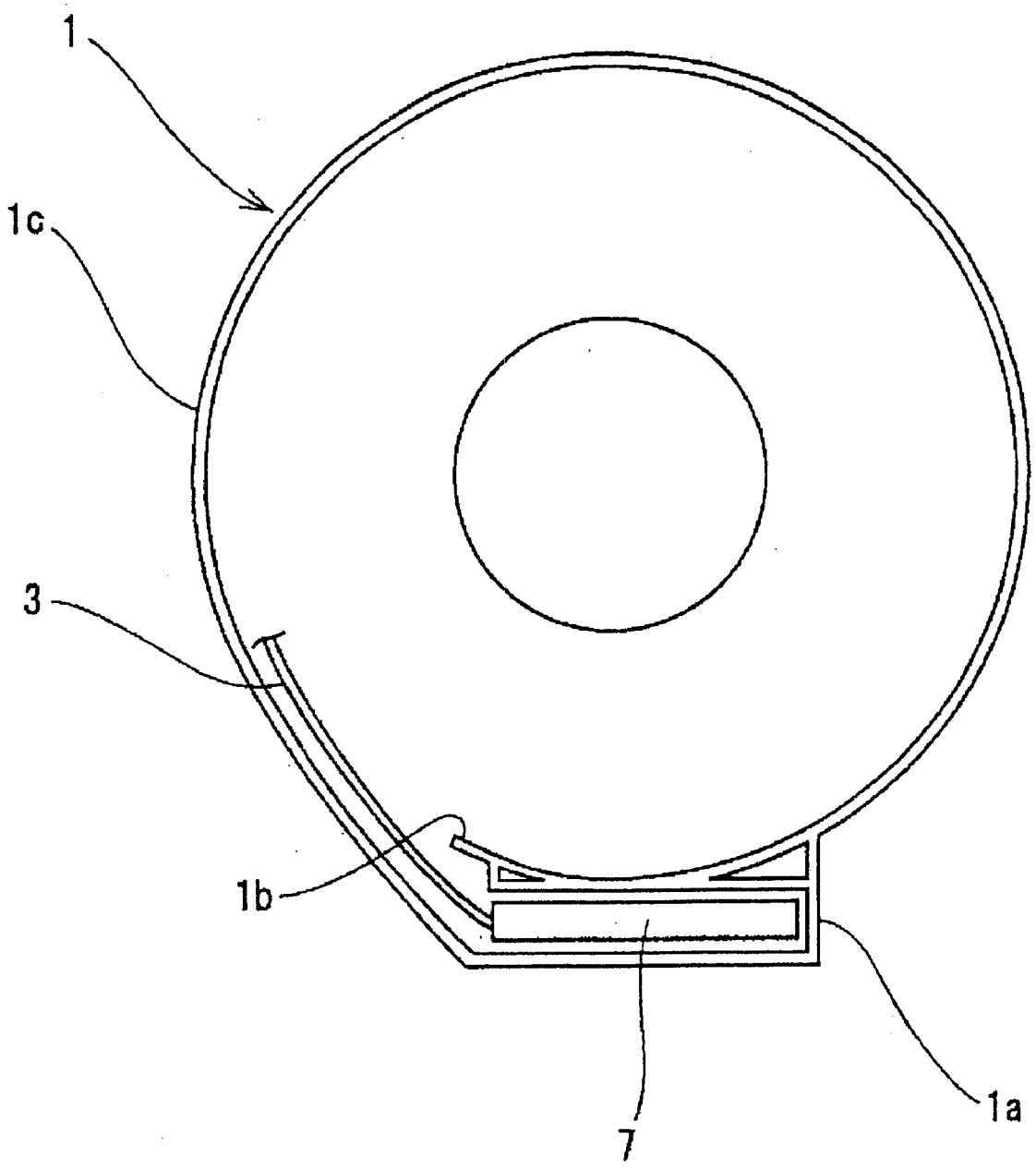
FIGURE 8 PRIOR ART
FIG. 8 is a top view of the prior art inner case, illustrating the inner case attached to a stationary member.

Inner cases connected to the opposite ends of a flat cable in the present embodiments can be applied to the conventional cable reel shown in FIG. 6. Since a general structure of a cable reel in the present invention is the same as that of the prior art cable reel shown in FIG. 6, an explanation of the general structure is omitted here.

Figure 2:
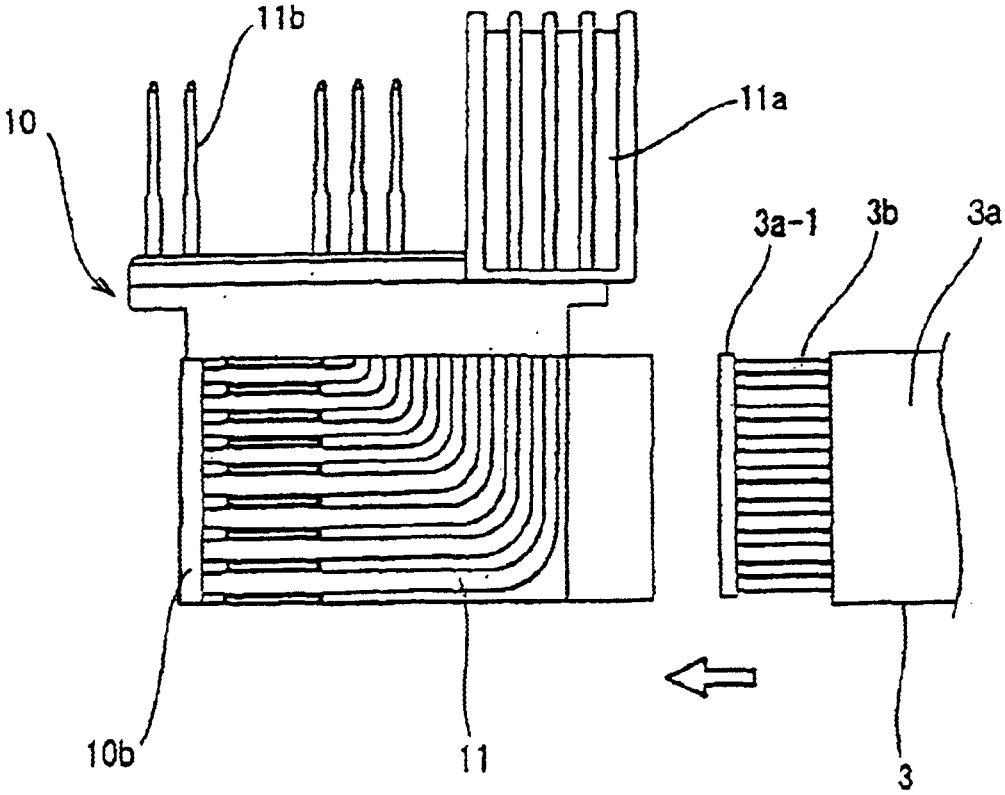
FIG. 2 is a longitudinal sectional view of the inner case of the first embodiment.
Figure 3:
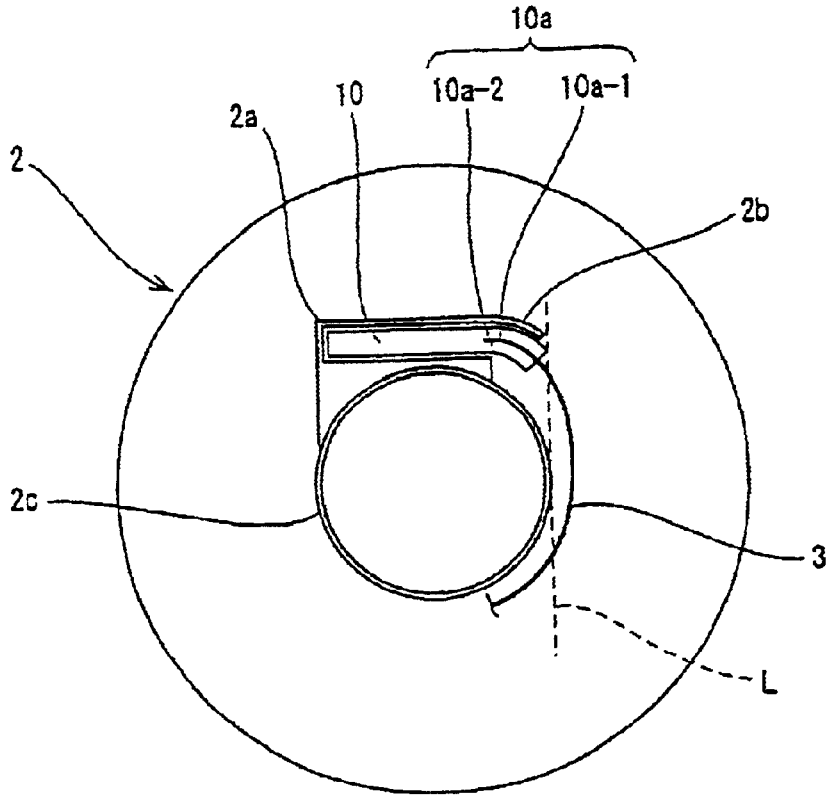
FIG. 3 is a bottom view of the inner case of the first embodiment, illustrating the inner case attached to a movable member.

FIGS. 1 through 3 illustrate a first embodiment of a cable reel in accordance with the present invention.

A first inner case 10 is connected to an end of a flat cable 3 and attached to a movable member 2. A first protection rib 10*a* extends from an end surface of the first inner case 10 to guide and hold a flat cable 3. The first protection rib 10*a* includes an arcuate outer peripheral wall 10*a*-1 and an arcuate inner peripheral wall 10*a*-2. The walls 10*a*-1 and 10*a*-2 are opposed to each other to define a cable-threading path for the flat cable 3 and to hold a portion of the flat cable 3 extending from the inner case 10 between the walls 10*a*-1 and 10*a*-2.

As shown in FIG. 2, an end of a bus bar 11 extends to an end wall 10*b* in the first inner case 10 while a portion 11*a* of the other end of the bus bar 11 is connected to lead wires L/W (FIG. 1) and the remainder of the other end of the bus bar 11 extends from a top portion of the first inner case 10 to serve as a terminal portion 11*b*.

Conductive elements 3*b* in an end of the flat cable 3 are exposed by stripping an insulation layer 3*a* except for a distal end 3*a*-1 of the insulation layer 3*a*, as shown in FIG. 2. The distal end 3*a*-1 of the flat cable 3 abuts the stopper wall 10*b* and the conductive elements 3*b* are connected to the bus bar 11 by welding or soldering.

FIG. 3 shows a bottom view of the movable member 2. The first inner case containing portion 2*a* is provided adjacent an inner cylinder 2*c*. The guide rib 2*b* extends arcuately from a cable outlet portion of the first inner case containing portion 2*a*.

A process for assembling the first inner case 10 onto the movable member 2 will be described below.

The first inner case 10 is inserted downwardly into the first inner case containing portion 2*a* with the terminal portion 11*b* (shown in FIG. 2) being directed, as shown in FIG. 3, toward the part 2*a*. The flat cable 3 is not caught by the guide rib 2*b* provided on an end of the cable outlet portion, since the first protection rib 10*a* of the first inner case 10 engages the guide rib 2*b*. This prevents the flat cable from being damaged.

Since the inner and outer peripheral walls 10*a*-2 and 10*a*-1 of the first protection rib 10*a*, that serve to protect opposite side surfaces of the flat cable 3, are formed into an arcuate configuration, an outer shape of the first inner case 10 including the first protection rib 10*a* is substantially the same as an inner shape of the first inner case containing portion 2*a* including the guide rib 2*b*, thereby increasing the efficiency of the insertion operation of the first inner case 10 into the first inner case containing portion 2*a*.

As shown in FIG. 3, a distal end of the first protection rib 10*a* of the first inner case 10 is positioned on a tangential line L on an outer peripheral surface of the inner cylinder 2*c* of the movable member 2. Consequently, it is possible to prevent the flat cable 3 from being curved excessively toward the outer cylinder 1*c* when the flat cable 3 is introduced into the annular space.

Further, it is possible to smoothly lead the flat cable 3 from the reel while the flat cable 3 is being restrained in a coiled manner, since the first protection rib 10*a* is formed into an arcuate configuration.

Figure 4:
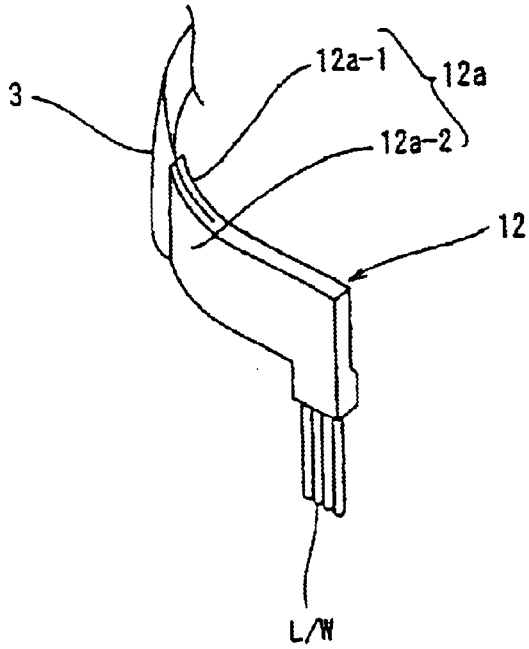
FIG. 4 is a perspective view of an inner case of a second embodiment in accordance with the present invention.
Figure 5:
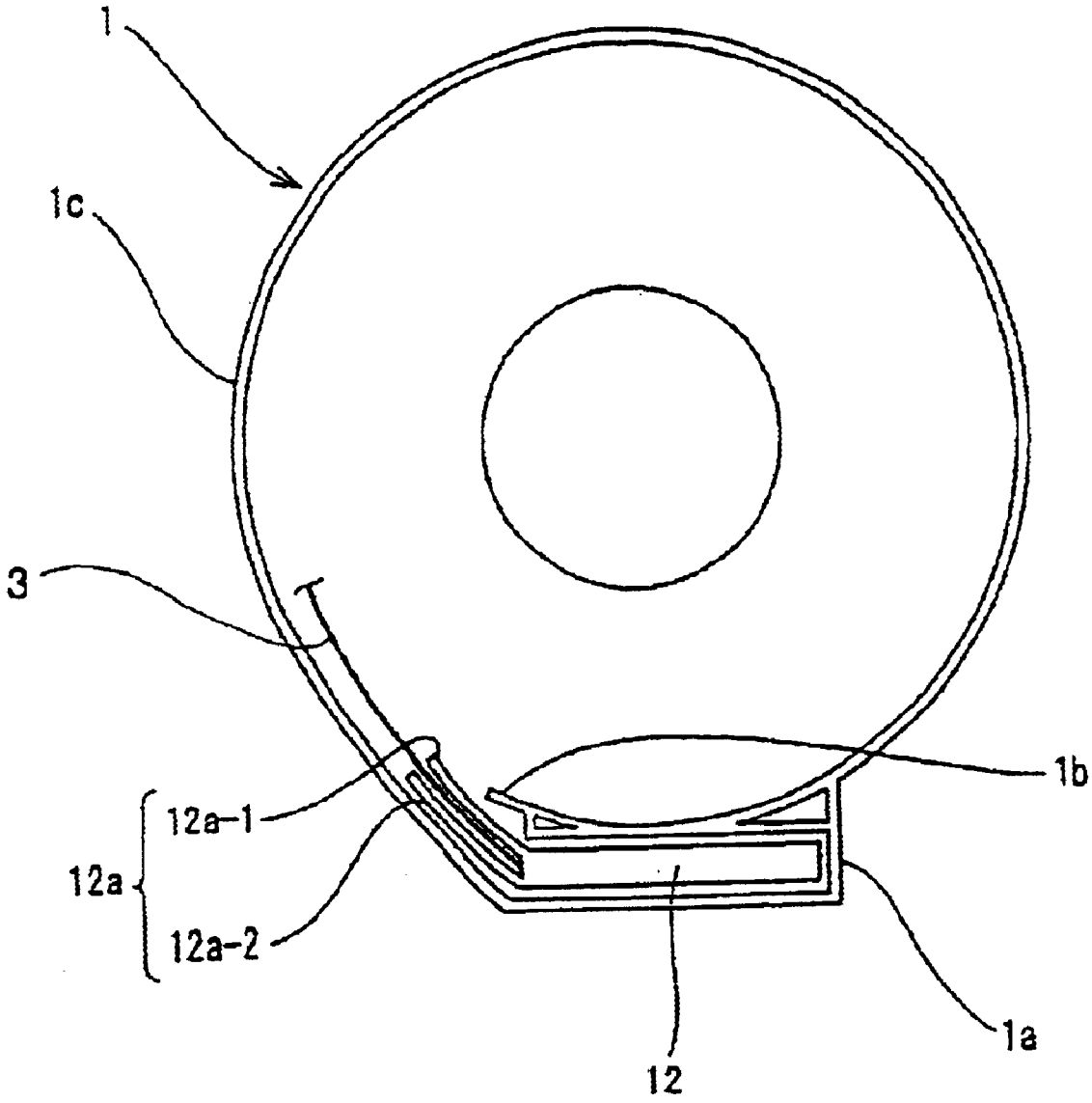
FIG. 5 is a top view of the inner case of the second embodiment, illustrating the inner case attached to a stationary member.

FIGS. 4 and 5 illustrate a second embodiment of a cable reel in accordance with the present invention.

A second inner case 12 is connected to the other end of a flat cable 3 and attached to a stationary member 1. A second protection rib 12*a* extends from an end surface of the second inner case 12 to guide and hold a flat cable 3. The second protection rib 12*a* includes an arcuate inner peripheral wall 12*a*-1 and an arcuate outer peripheral wall 12*a*-2. The walls 12*a*-1 and 12*a*-2 are opposed to each other to define a cable-threading path for the flat cable 3 and to hold a portion of the flat cable 3 extending from the second inner case 12 between the walls 12*a*-1 and 12*a*-2.

As described in the first inner case 10 of the first embodiment, each bus bar 11 is contained in the second inner case 12. An end of the bus bar 11 is connected to the conductive elements 3*b* in the flat cable 3 while the other end of the bus bar 11 is connected to lead wires L/W forming an external circuit.

FIG. 5 shows a top view of the stationary member 1. The second inner case containing portion 1*a* is provided in a portion of an outer cylinder 1*c*. The guide rib 1*b* extends arcuately from a cable outlet portion of the second inner case containing portion 1*a*.

A process for assembling the second inner case 12 onto the stationary member 1 will be described below.

The second inner case 12 is inserted downwardly into the second inner case containing portion 1*a* in FIG. 5 with the lead wires L/W being directed to the portion 1*a*. The flat cable 3 is not caught by the guide rib 1*b* provided on the cable outlet portion of the portion 1*a*, since the second protection rib 12*a* of the second inner case 12 engages the guide rib 1*b*. This prevents the flat cable from being damaged.

Since the inner and outer peripheral walls 12*a*-1 and 12*a*-2 of the second protection rib 12*a*, that serve to protect opposite side surfaces of the flat cable 3, are formed into an arcuate configuration, an outer shape of the second inner case 12 including the second protection rib 12*a* is substantially the same as an inner shape of the second inner case containing portion 1*a* including the guide rib 1*b*, thereby increasing the efficiency of the inserting work of the second inner case 12 into the second inner case containing portion 1*a*.

From the above description of the invention, those skilled in the art will perceive improvements, changes and modifications. Such improvements, changes and modifications within the skill of the art are intended to be covered by the appended claims.

Although the invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The present disclosure relates to subject matter contained in Japanese Patent Application No. 2001-215706, filed on Jul. 16, 2001, which is herein expressly incorporated by reference in its entirety.

What is claimed is:

1. A cable reel in which a movable member forming an inner cylinder is rotatably coupled to a stationary member forming an outer cylinder and a flat cable is positioned in an annular space defined by the stationary and movable members, first and second inner cases that accommodate bus bars connected to conductive elements in the flat cable are attached to longitudinal opposite ends of the flat cable, the bus bars extend from the first and second inner cases, and the first and second inner cases are fixed in first and second inner case containing portions provided in the movable and stationary members, respectively, one of said first and second inner cases comprising:

a first protection rib integral with one of said first and second inner cases and extending from an end surface of a cable outlet portion of said one of said first and second inner cases;

wherein said first protection rib includes an arcuate portion defining a cable threading path.

2. The cable reel according to claim 1, wherein a distal end of said first protection rib is positioned on a tangential line on an outer peripheral surface of said inner cylinder of said movable member.

3. The cable reel according to claim 1, wherein said first protection rib extends from an end surface of a cable outlet portion in said first inner case fixed in the first inner case containing portion in the movable member, said cable reel further comprising:

a second protection rib extending from an end surface of a cable outlet portion of said second inner case fixed in the second inner case containing portion in the stationary member; and wherein said second protection rib includes an arcuate portion defining a second cable threading path.

4. The cable reel according to claim 3, wherein a distal end of said second protection rib is positioned on a tangential line on an outer peripheral surface of said outer cylinder of said stationary member.

5. The cable reel according to claim 1, said first protection rib comprising:

an inner arcuate peripheral wall and an outer arcuate peripheral wall, said inner and outer arcuate peripheral walls being opposed to each other and defining said cable threading path therebetween.

6. The cable reel according to claim 1, wherein said first protection rib extends from an end surface of a cable outlet portion in said first inner case fixed in said first inner case containing portion provided in the movable member.

7. The cable reel according to claim 6, wherein said first inner case containing portion includes an arcuate guide rib, and said arcuate portion of said first protection rib is configured to engage said arcuate guide rib.

8. The cable reel according to claim 5, wherein said inner and outer arcuate peripheral walls extend from an end surface of a cable outlet portion in said first inner case fixed in said first inner case containing portion provided in the movable member.

9. The cable reel according to claim 8, wherein said first inner case containing portion includes an arcuate guide rib, and said inner and outer arcuate peripheral walls are configured to engage said arcuate guide rib.

10. The cable reel according to claim 1, wherein said first protection rib extends from an end surface of a cable outlet portion in said second inner case fixed in said second inner case containing portion provided in the stationary member.

11. The cable reel according to claim 10, wherein said second inner case containing portion includes an arcuate guide rib, and said arcuate portion of said first protection rib is configured to engage said arcuate guide rib.

12. The cable reel according to claim 5, wherein said inner and outer arcuate peripheral walls extend from an end surface of a cable outlet portion in said second inner case fixed in said second inner case containing portion in the stationary member.

13. The cable reel according to claim 12, wherein said second inner case containing portion includes an arcuate guide rib, and said inner and outer arcuate peripheral walls are configured to engage said arcuate guide rib.

14. The cable reel according to claim 3, said second protection rib comprising:

an inner arcuate peripheral wall and an outer arcuate peripheral wall, said inner and outer arcuate peripheral walls of said second protection rib being opposed to each other to define said second cable threading path therebetween.

15. The cable reel according to claim 3, wherein said first inner case containing portion includes a first arcuate guide rib, and said arcuate portion of said first protection rib is configured to engage said first arcuate guide rib; and wherein said second inner case containing portion includes a second arcuate guide rib, and said arcuate portion of said second protection rib is configured to engage said second arcuate guide rib.

16. The cable reel according to claim 14, wherein said first protection rib comprises an inner arcuate peripheral wall and an outer arcuate peripheral wall, said inner and outer arcuate peripheral walls of said first protection rib being opposed to each other to define said cable threading path therebetween;

wherein said first inner case containing portion includes a first arcuate guide rib, and said inner and outer arcuate peripheral walls of said first protection rib are configured to engage said first arcuate guide rib; and wherein said second inner case containing portion includes a second arcuate guide rib, and said inner and outer arcuate peripheral walls of said second protection rib are configured to engage said second arcuate guide rib.

* * * * *